United States Patent [19]

Davidson et al.

[11] Patent Number: 4,886,522

[45] Date of Patent: Dec. 12, 1989

[54] PROCESS, FOR THE DESULFURIZATION OF COAL

[75] Inventors: James G. Davidson; Deborah A. Allard, both of Elizabeth Town; Philip J. Sawyer; Philip E. Boynton, both of Marion, all of Ill.

[73] Assignee: Malin Research Corporation, Marion, Ill.

[21] Appl. No.: 157,781

[22] Filed: Mar. 3, 1988

[51] Int. Cl.[4] ..... C10G 9/02

[52] U.S. Cl. ..... 44/624; 44/623; 201/17; 209/166

[58] Field of Search ..... 44/622, 623, 624; 201/17; 209/166

[56] References Cited

U.S. PATENT DOCUMENTS

| | | | |
|---|---|---|---|
| 1,183,445 | 5/1916 | Foxwell | 44/501 |
| 4,057,398 | 11/1977 | Bennett et al. | 44/501 |
| 4,324,559 | 4/1982 | Porter et al. | 44/623 |

*Primary Examiner*—Carl F. Dees

*Attorney, Agent, or Firm*—Waters, Morse & Harrington

[57] ABSTRACT

A desulfurization process for coal ore for the removal of both organic and inorganic (pyritic) sulfurs in coal ore comprises a series of steps including the pulverizing of coal ore; mixing coal particulates with separation reagents, a catalyst and a vehicle; separating the recyclable chemicals and abstracted sulfurs through a select membrane; conditioning the particulates for flotation and sedimentation; clarifying the settleable ash and inorganic sulfurs and the floatable coal from the vehicle; and dewatering the collected coal particulates. The process also provides for regeneration of the catalyst.

14 Claims, 2 Drawing Sheets

PROCESS, FOR THE DESULFURIZATION OF COAL

BACKGROUND OF THE INVENTION

The present invention relates to a process for the desulfurization of coal in which the inorganic sulfur (pyrite) and the organic sulfur are removed from treated coal ore.

The dependance on fossil fuels, both in the United States and throughout the world as a source for energy and raw materials has created a demand that has inflated the price of those resources that are easily obtained and easily utilized. Alternate fuels which heretofore have been uneconomical or unfeasible to use as energy or raw material sources would be readily accepted if they could be made compatible with the economic and environmental requirements. Specifically, the use of high sulfur coal would be particularly advantageous if economical processes for reducing the sulfur content could be employed allowing the desulfurized coal to be used in the place of the more expensive naturally occurring low sulfur coals.

The high sulfur coals the bulk of the coal reserves that have been located and identified. As an energy resource, it has been predicted that these known reserves would sustain domestic United States requirements for the next 200 years. At present, commercial exploitation of these reserves is severely limited since the combustion of high sulfur coal results in significant air pollution which typically requires costly abatement procedures for use. Even though abatement procedures can be effective at reducing the sulfur dioxide emissions, none are recognized to be 100 percent effective 100 percent of the time. This situation elevates concerns about the continued use of high sulfur coal products, especially with regard to acid rain.

An alternative to the abatement practices employed in the use of high sulfur coals, is to remove the offending sulfur compounds prior to combustion. An economical and feasible process for achieving this would allow the utilization of coal reserves, largely untapped, thereby reducing dependence on alternate fossil fuels, and at the same time reducing the concerns and chances for environmental pollution. The present invention, as will be seen, achieves the dual goals of efficiency and economy that are required to maximize the utilization of the vast reserves of high sulfur coal.

The inclusion of sulfur in coal occurs in two forms primarily. The first is inorganic, or pyritic, which generally occurs as pyrite, $FeS_2$, and associated compounds. The second is organic sulfur, which is sulfur that is linked to the hydrocarbon composition of the coal itself. The distinction between the two forms of coal-related sulfurs is further evidenced in their respective chemical reactivity. The pyritic form undergoes reactions more consistent with ionic salts. The dominance of the iron in the compound also dictates physical characteristics that may be exploited for purposes of separation. The organic sulfurs, on the other hand, exhibit covalent bonding characteristics more like that of organic molecules. Since the desired end product in the desulfurization of coal is an organic constituent, physical differences between the organic sulfurs and final product cannot be exploited as easily as in the case of the pyritic sulfurs. Thus, it becomes necessary to utilize other chemical properties of the organic sulfur in order to achieve separation yields of any significance.

The physical removal of the pyritic sulfurs from coal has been achieved by a number of means, both physical and chemical. While some processes for pyritic removal are relevant in terms of feasibility and economy, without the co-removal of organic sulfurs, the ultimate utilization of any such process is severely limited. However, successful pyritic removal has occurred through the use of floatation, oil-water separation, magnetic separation, and combinations of thermochemical and magnetic processing to name a few. The utilization of these techniques has resulted in a satisfactory result when the interest is in the removal of the pyritic sulfur content exclusively. As mentioned before, this focus results in limitations in applying the technique to all coals since the organic sulfurs are still resident after treatment.

Attempts to liberate the organic sulfurs from coal have included chemical treatment, as would be expected, particularly with carbon disulfide, and also by application of thermal energies to initiate intramolecular liberalization of sulfur. A two-step process for desulfurization of organic sulfurs is known where the coal is subjected to an oxidizing environment and then subsequently treated with alkaline solutions. These processes all suffer from the necessary input of resources, either chemical or thermal, that cannot be recovered and otherwise impair the economic feasibility of the desulfurization process.

More recently, work has been done utilizing olefins, aldehydes or ketones that effectively react as "sulfur traps" in reactions with organic sulfurs. These reactions occur under pressure which shifts the equilibrium of the trapping reaction towards the sulfurized trapping material. Once the pressure on the separated sulfurized trapping material is reduced and the temperature is elevated, the reaction is reversed to release hydrogen sulfide and regenerate the original trapping reactant. The process takes place under conditions of elevated temperature and pressure and requires batch processing by reactor.

Another recent effort in the removal of organic sulfurs involves the washing of coal particles with an aqueous solution of copper ions. The process proceeds under elevated conditions of temperature and pressure and allows both organic and inorganic sulfurs to be dissolved in the copper solution. After sufficient reaction time has been established, the coal solids are rinsed free of the copper solution thereby separating the solubilized organic and inorganic sulfurs from the remaining coal solids. Both this process and the previously discussed process using olefins, aldehydes and ketones requires the step-wise treatment of coal in reaction vessels. While the recent processes have reduced the cost of chemical inputs, the efficiency is limited by batch type procedures requiring capital intensive equipment.

Despite the obvious incentives for feasible processes for the organic and inorganic desulfurization of coal, no one process has been able to demonstrate efficiency and economic feasibility in the continuous production of low sulfur coal products. The present invention achieves such a result in a manner not related to the processes previously known.

SUMMARY OF THE INVENTION

In accordance with the present invention, a process for the desulfurization of coal ore containing both organic and inorganic (pyritic) sulfurs, continuously removes the organic and inorganic sulfurs and produces a low sulfur coal of exceptional quality.

In the process of the present invention, coal is initially pulverized preferably to a particle size of 150 microns or less. The coal particulates are combined with abstraction chemicals (a liquid catalyst and separation reagents) and a suspension liquid vehicle (preferably water, alcohol or combination thereof forming a slurry that is mixed and allowed sufficient contact time to react with the organic sulfurs contained in the coal. The catalyzed reaction abstracts organic sulfurs from the coal and releases them to the slurry solution. The slurry solution is then transferred to a membrane cell where the selective porosity of the membrane allows removal of the catalyst and the organic sulfur and remains impermeable to the coal and water.

The coal thus being stripped of its organic sulfur may be treated further for the removal of pyritic sulfurs. The coal and water mixture is transferred to a conditioner where agents inducing flotation and sedimentation are added and allowed to mix. The solution is then transferred to clarifying or sedimentation cells where reaction conditions are monitored and regulated and additional frothing agent is added. Through a series of sedimentation and flotation cells the coal and pyritic materials water are separated, and the pyritic sulfurs are removed.

The separated desulfurized coal particles are transferred to a dewatering device and are recovered as the desulfurized coal product. The clarified water and the recovered catalyst may be returned to the process and hereby recycled.

DETAILED DESCRIPTION OF THE PREFERRED EMBODIMENT

Figure 1:
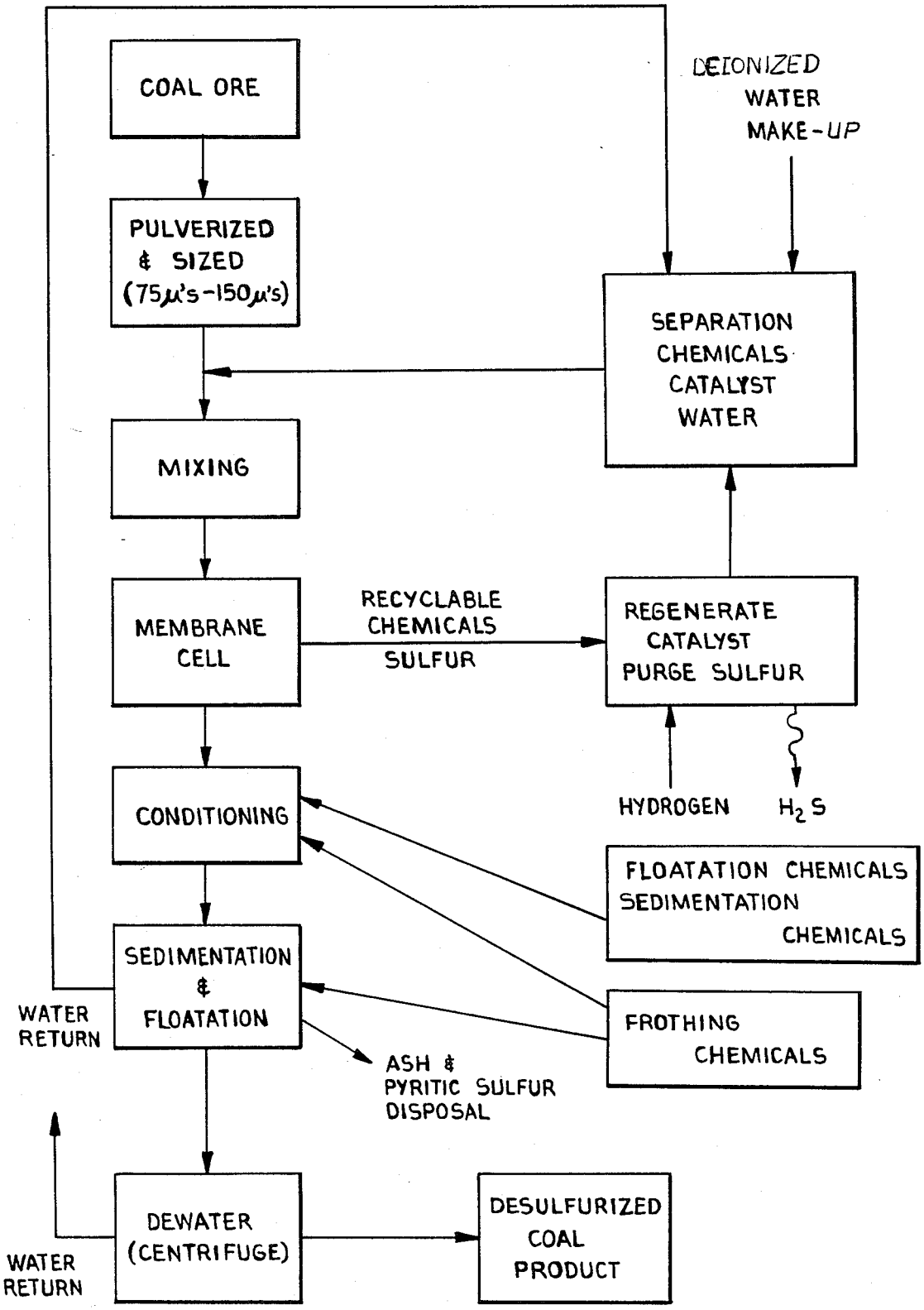
FIG. 1 is a bl;ock diagram showing the process of the present invention.
Figure 2:
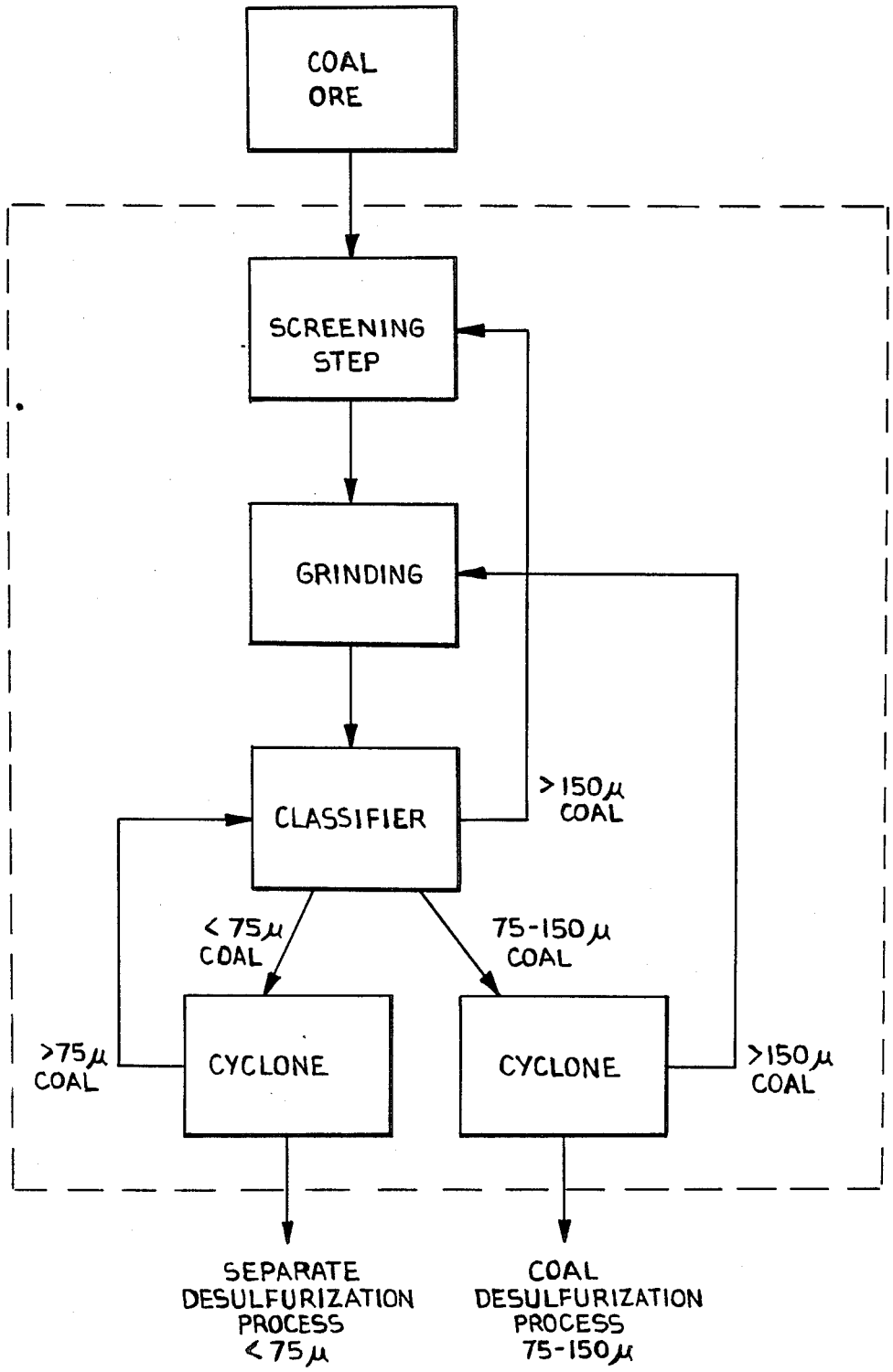
FIG. 2 is a block diagram showing the pulverizing and sizing process of the present invention.

In accordance with the present invention a description for the process of the desulfurization of coal ore is described below. The process provides for an effective and unique treatment of high sulfur coals that results in the removal of substantial quantities of organic sulfurs and inorganic sulfurs without the inputting of significant and irretrievable amounts of chemicals or energy.

Coal Sizing

The process commences with the controlled pulverizing of raw coal ore. The actual grinding and pulverizing may be accomplished by conventional equipment already known in the industry. The requirements of the preferred embodiment, however, dictate that some uniformity is established and that limits are placed on the particle size. These requirements are easily met by staging the equipment progressively so that a high degree of confidence is established in the coal sizing as it is outputted from this part of the process.

The crude ore is first screened in the preferred embodiment. Particles that pass through the screening process are less than 150 microns and are immediately routed to a classifier while the bulk of the ore is passed on to the grinder. In the present invention, a dual-rotor breaker is used to perform the bulk of the grinding of the crude ore. The output from the breaker is similarly passed on to a classifier that is calibrated to segregate particles in the 75 micron to 150 micron range. Particles less than 75 microns are treated as fines and are handled in a similar but separate process. The particle sizing is insured by the use of cyclones calibrated at speeds that separate the specified coal particles from particles larger than 150 microns. Thus, a portion of the output from the cyclone is returned to a wet grind process and rerun through the classifier.

By progressively staging the grinding of the coal ore, the particles entering the chemical process are relatively uniform in terms of size and distribution. The maximum efficiency obtained to date in the preferred embodiment is with a preferential particle size of 106 microns. Testing has indicated that when the mode particle size is the indicated 106 microns, that approximately 12% of the particles will range above the 106 micron level up to 150 microns. Essentially no particles above 150 microns are found under these conditions. The lower range of particle size has been fixed at 75 microns for reasons related to equipment characteristics and product handling. Particle sizes less than 75 microns are designated as fines and are optionally side streamed through a parallel treatment process. In this fashion the maximum throughput of coal particles is insured while provisions are made for the collection of nuisance particles that would otherwise accumulate as dust or waste.

The coal sizing operation is a critical factor in the successful processing of coal for the removal of organic and inorganic sulfurs. The sizing accomplishes two necessary objectives; the first being the release of the mineral or pyritic sulfurs by the physical breaking apart of the coal solids. Numerous processes have employed similar techniques for accessing pyritic sulfurs in coal and the requisite parameters are well known in the industry. The second objective achieved by the pulverizing and sizing process is the increase in the surface area in the remaining coal compounds. This maximizes the access of reagent chemicals to the organic sulfurs. The balance between the particle size and the efficiency of the process is such that decreasing particle size further will not significantly increase the yield of desired low sulfur coal, and conversely increasing the particle size will reduce the efficiency of the chemical processing and result in coal product of predictably higher sulfur content. In some instances, it may be desired in terms of equipment and process utilization to fix the particle size greater than 150 microns. This would be conceivable where the input coal contains sulfur in moderate total amounts or in a proportion between organic and inorganic that allowed the output of coal with acceptable sulfur levels under conditions of reduced organic sulfur removal. It remains, nonetheless, the objective of the present invention to achieve the cleanest coal product possible under practical economic and production restraints.

Organic Sulfur Removal Process

The organic sulfur found in coal ore is covalently bonded to portions of the carbon skeletons found in the various compounds comprising the coal itself. The actual compounds are diverse and are of varying chain lengths. Notwithstanding the diversity and differences in the sulfur compounds, they are dependable and predictable in terms of their reactivity as organic sulfurs. It is this reactivity which allows the sulfur to be selectively abstracted from the coal particles. In the present invention, this reactivity is exploited to abstract and mobilize the sulfur in a form that allows it to be collected and separated from the bulk of the process stream itself.

The first step in abstracting the organic sulfur requires mixing or suspending the coal particulates in water or alcohol or combinations thereof. This may be done on a batch basis, but the preferred embodiment utilizes a continuous flow through system in order to maximize product output. Preferably a cell is made to receive the previously sized particulates of coal by any continuous transfer means, such as a conveyor or pump. The particles thus received are flash mixed under continuous agitation with regulated quantities of water or alcohol. The water added in the present invention is preferably a deionized water which reduces the potential interferences in the reactivity of the process, and as will be discussed momentarily, enhances the efficiency of some of the process components. In the preferred embodiment, water is added to ground coal in the ratio of 9:1, and in the case of alcohols, in the ratio of 9.37:1, weight to weight.

Alcohols may be substituted as a matrix for coal particulate suspension. Typically these would be methanol or ethanol that appear to react and perform as well as the aqueous matrix. The advantages in using water remain chiefly in the low cost, ready availability, and lower volatility.

While the coal particulates and water are being agitated or slurried, the first reagent is added to the cell. This reagent is a hydrogen donating compound, preferably a hydride. The covalent sulfur bonds in organic sulfur compounds can be subjected to hydrogenation and caused to reduce the sulfur and induce it to leave the parent organic compound. Preferably the hydride of choice for this purpose is a modified sodium borohydride prepared by reacting condense dibromic with tetra alkoxyborate, which exhibits a more manageable behavior under the aqueous conditions in the mixing cell. In the alternative, or in combination, cyanoborohydride may be used with similar ease although with somewhat less efficiency in penetrating the carbon-sulfur bonding. The radicalized organic compound may be reduced totally at the site of the leaving sulfur, thereby consuming the donated hydrogens. In any event, any hydride residue may react with other constituents in the aqueous mix or may be evolved as small amounts of hydrogen gas, the residual hydride having no impairment on the second phase of the chemical treatment.

The addition of sodium borohydride, sodium tetraborohydride or sodium tris-borohydride in the preferred embodiment may occur in any effective concentration up to approximately 8.8 pounds of modified hydride per 10,000 pounds of coal-water suspension. Excess hydride may be added without adverse impairment. The initial reaction readily and spontaneously occurs under ambient conditions and preferably at a pH of 7.0 although reactions are sufficiently propagated throughout the pH range of 6.2 to 8.6. Provisions are made to control pH, since variations in the acid/alkaline balance will alter the rate and efficiency of the hydrogenation reaction. In particular, increasing alkalinity will slow or even stop the reaction.

In addition to the hydride, a second reagent is added to the aqueous mix in order to promote selective separation of the sulfur compounds cleaved from their organic parent compound. This reagent is more properly classified as a catalyst since it is subject to regeneration and recycling within the process. The reagent is comprised of molybdenum in solution in an aromatic olefin. The preferred olefin is benzene in which molybdenum is soluble. The reactions of molybdenum are complex and not totally understood. Molybdenum may exist in a number of valence states, although it is not typically thought to be a strongly ionic species.

In the present invention, the molybdenum solution is added to the mixer cell where it comes in contact with the liberated sulfurs in the aqueous solution. The organic nature of the benzene solvent resists any significant solubility in the aqueous matrix. Under enforced agitation, contact with the constituents of the aqueous matrix is made and the sulfur is thought to be temporarily trapped by its well known tendency to react with olefins. Transfers between the sulfur saturated olefins and the molybdenum takes place spontaneously at room temperature and pressure conditions. This allows the molybdenum disulfide thus generated to act as a convenient transporter of sulfur and retards reversibility in the reaction between sulfur compounds and the organic parents in the coal particles.

In the preferred embodiment, a 52.78% solution of molybdenum in benzene is added to the coal suspension at the rate of 15.2% weight to weight. The reactions initiated by this catalyst occur readily at a pH of 7.0. A total addition of hydride and catalyst compounds of 0.88 pounds per 1,000 pounds of coal suspension has proven effective in pilot runs. Amounts greater than this should not adversely affect coal desulfurization other than in economic terms. Lesser amounts may be used depending on the parameters of coal and process, the relationship being determined by the effective amount of catalyst required for abstraction of accessible organic sulfurs.

Upon recycle of the molybdate/benzene solution, an addition of 3.2% of diaryl sulfide is made to retard benzene reactions.

The mixing of both the hydride and catalyst compounds is sufficient after three minutes under most conditions. Individual system characteristics and coal quality may require longer mix periods under certain conditions.

At this stage of the process, the combined slurry is transferred to a membrane cell. The transfer again is preferably continuous and is kept under sufficient velocity or agitation so as to keep the slurry suspended until received by the membrane cell. Preferably, the membrane cell is a flow through type in keeping with the continuous nature of the present process. The membrane cell also deploys a reverse osmosis membrane at a secondary outlet. The selected membrane allows the permeable transport through the membrane of the reacted molybdenum catalyst including the sulfur. The remaining coal particles and water are not permeable to the membrane, and after retention in the cell for 3.0 to 11.5 minutes, exit for the next step of the process.

The membrane used for the permeable removal of catalyst reagents and sulfur preferably is a cellulose acetate polymer type. This particular membrane has been shown under testing to provide optimal performance in the separation of the desired groups. The typical reverse osmosis membrane requires a driving force to establish a gradient, either physical or chemical, in order to function. In the present case, a slight pressure gradient is developed across the membrane althought this gradient is considerably lower than those thought to be required in the past. This unexpected result has been achieved by the recent availability of reduced effective thickness membranes. By employing a membrane of this type, a greater throughput is achieved while still maintaining the desirable aspects of a continuous flow through system.

The pores or passage of the selected reverse osmosis membranes have apparent diameters of 8 microns. The membrane achieves practical transfer characteristics through recently developed techniques that allow extremely thin and selective films to be mated with thicker less selective films. The result is a highly selective membrane with increased transfer properties.

The recyclable chemical and recovered sulfur are collected on the non-process side of the membrane. The liquors may be drawn off continuously or pumped away for storage or as described below, regeneration.

As is the case with typical membrane systems, periodic backwashing is needed to restore the permeability. Since the transmembrane gradient is a lower pressure than would be found in other reverse osmosis applications, the backwash cycle may proceed with a reduced pressure sufficient to overcome the gradient. Membrane life may well be enhanced by this circumstance and actual testing has indicated that four complete cycles can be realized in use. The cycles on the membrane can vary with the kind and quality of the coal being processed, the strength and concentration of the reagents, and the quality of the water. As mentioned before, the deionized water is preferentially used, which in this case reduces loading on the membrane presumably by elimination of the divalent cations found in the average water supply.

The combined catalyst reagents and sulfur separated by the membrane are collected and recycled. The recycling of the molybdenum-benzene solution is accomplished by purging the sulfur from the molybdenum disulfide by hydrogen evolvement. The source of the hydrogen may be obtained from many conventional sources such as gas, electrolysis, or hydrogen from dissociated ammonia. The restoration of the molybdenum-benzene solution and the evolvement of hydrogen sulfide from the recovered mix allows the molybdenum-benzene solution to be returned to the mixer cell and participate further in the separation of organic sulfur.

Conditioning and Floatation

The coal particulates outputted from the membrane cell have had the organic sulfurs stripped and removed. The remaining inorganic sulfurs as previously discussed exist primarily in the pyritic form which are subject to selective processing for removal as well. In this case, the solution is prepared for the simultaneous floatation of the coal solids and the sedimentation of the pyritic and ash particles. Both floatation and sedimentation of pyritic sulfurs have been used in the processing of coal and are well known in that industry. The advantages of the present invention are such that the results of the organic sulfur removal process are consistent with subsequent pyritic removal.

The coal particle and water suspension is transferred from the membrane cell into a conditioner cell in this stage of the process. As before, the suspension is transferred under such conditions of velocity and agitation as to maintain homogenous suspensions of the coal while continuously processing the product stream. Once received in the conditioner cell, the suspension is subjected to chemical additions and solution regulation in order to promote the sedimentation of the mineral type compounds. Reagents for promoting floatation of the coal particulates are added as well, the combinations being considered part of the conditioning. The chemicals used in the conditioner cell include the initial reagents pyrogallol, dichlorodimethylsilane, zinc chloride, and methyl or ethyl xanthates in the approximate proportion of 3.11:2.07:0.10:4.71, and are added to the presented suspension at the approximate rate of 2.12 pounds per 100,000 pounds of suspension. The rate of addition may vary since factors such as coal characteristics will affect the conditioning.

Many flotation systems employ tannins in the flotation process. The use of pyrogallol in such applications also is known. The tannins have a marked effect on the wetting properties of aqueous solutions. In particular, it is known that they have an affinity for the pyritic particles suspended in water and will associate with these and similar particles. Pyrogallol also associates with the pyritic particles. This at first induces settling of the pyritic particles but later induces flotation after allowing for periods of standing time. In the continuous process of the present invention, it is beneficial to induce flotation quickly and efficiently by aeration, so that the floating coal particles can be removed before the pyritic particles float.

The introduction of gas bubbles at the beginning of the flotation process allows the small bubbles to be trapped by the coal particles. The buoyancy of the coal is increased, further enhancing the speed and degree of flotation.

In the preferred embodiment, the pyritic materials may be subject to floatation or to precipitation depending on the residence time selected. Experimentation has shown that after admixture for the first three minutes, pyritic materials settle to the bottom, while the coal rises to the surface. They remain effectively separated from the three minute time until about seven minutes, when the pyritic particles rise to the point where admixture commences. After about eleven minutes, all separation is effectively lost. Practical results may be obtained with resident times within the three to seven minute range depending on coal characteristics and process conditions.

Other tannins can be used in place of pyrogallol to achieve essentially the same initial results. A second dosage of a select tannin, quebracho, is used in the present invention to further enhance and accelerate separation, this occurring as a 3% weight to weight ratio of quebracho to suspension. This modified tannin has been shown in testing to accelerate the settling process over that typically seen with pyrogallol alone and exhibits specific effect in concentration ranges of 1.2% to 3.0%.

Compatibly commencing at the same time as flotation is the sedimentation or flocculation of the solids being carried in the suspension. Additions of zinc chloride and methyl or ethyl xanthates are added in order to achieve a coalescence of the remaining particles . While some of the additions of the zinc chloride and xanthates may become included in the final coal product, the expense and physical occurrence are not detrimental to the process. The coalesence of these groups results in product that is less buoyant and precipitates at a faster rate.

Other coalescing agents may be used in much the same manner, especially the class of ionic coagulents or resins, which can be particularly useful. These polymeric resins are well known in the industry, and experience with these compounds indicates that the application of each such individual resin type must be carefully tested against the particular kind and quality of coal being processed. These resins have individual chemical characters that vary dramatically with the conditions of the colloidial solution or suspension presented. The dosage rates for the xanthates and the polymers are determined for each process by bench top trials.

The use of dichlorodimethylsilane is useful in the preferred embodiment, it is believed, by regulating the surface tension properties of the aqueous solution in order to achieve the optimal bubble sizes for flotation purposes. There also may be other chemical benefits in the use of this product.

The conditioning of the suspension commences with vigorous agitation and variation. The density of the suspension is regulated preferentially to about a 15.2% mix (weight to volume) of coal particles to water. Conditions remain at room temperature and pressures throughout the flotation process. Suspension densities may vary, especially if the average particle size is less than the 106 micron range. Optimal densities for reaction purposes are determined on a case by case basis; however, coal suspensions above 15.2% are difficult to process. The reagents pyrogallol, dichlorodimethylsilane, zinc chloride and the xanthates are mixed and contact is allowed for approximately three minutes. An addition of the quebracho in the preferential amount is made, and the suspension is mixed further for ten seconds.

At this point, the conditioned suspension is transferred to another cell with simultaneous addition of agents designed to induce what is known as frothing. Frothing is considered a necessary step in efficient flotation since it increases the affinity of the coalesced particles for attachment of the bubbles produced by the aeration step. In the present invention, the frothing agents of choice are eucalyptus oil, cresylic acid, and a butylalcohol residue marketed by Dow Chemical Company and known as Dow Froth special selection (Aug. 21, 1987).

The eucalyptus oil is combined with the cresylic acid at a 1:2 ratio. Approximately 1.5 gallons of this solution is added per gallon of Dow Froth and is used as the frothing agent in the preferred embodiment. This combined agent is typically applied at the rate of approximately five gallons per 100,000 gallons of suspension. Effective rates of application may vary as do the other chemical parameters.

After the addition of the frothing agents, the suspension is again continuously transferred to other receiving cells where sedimentation and flotation commence in earnest. In these sedimentation cells additional conditioning or frothing agents may be added as needed in order to replenish chemicals as they are reacted or removed. The suspension is allowed to quiescently traverse through the sedimentation cells, where the coal is collected at the surface and the settleable solids are collected at the bottom of the cells. The actual residence time is dependent on the selection of flotation and settling reagents, the amount of air entrained, the volume of flow and capacity of the cells, and similar criteria. In the present invention, an average settling time of three to seven minutes achieved acceptable results.

The sedimentation and flotation step may be modified by compressing individual process steps such as the addition of conditioning chemicals and frothing agents; however, loss of efficiency can be experienced as a result. Mechanical augmentation may be implemented as a matter of choice through the use of skimmers, flights, or lamella separators. These variations represent advantages that merely serve to shorten the residence time in the sedimentation-flotation phase of the process.

Final Separation and Dewatering

The last stage of the flotation process results in the accumulation of coal solids as coagulated from the aqueous matrix. The solids have now been stripped of both organic and inorganic sulfurs and can be collected continuously for dewatering and transport to final usage. The actual means for removal is well established in the industry and may consist of collection troughs, scrapers or flights, or merely transfer pumps.

The recovered coal product is thus transported through a dewatering device suitable for separating the small amounts of water that are transported with the coal. In the preferred embodiment the usage of a centrifuge has proved to be most effective. The models manufactured for this purpose by United Coal Company are competent to produce a finished product resulting in approximately 8% moisture content. The water fraction recovered, both by the centrifuge and at the outlet of the final step in the flotation process may be returned to the beginning of the process. This water retains some of the reagents added throughout the steps which typically remain at equilibrium levels low enough that they do not appreciably effect the individual steps. Testing has not yet provided results indicating whether this equilibrium has been fully established for each and every reagent, although repeated recycling has not resulted in any upsets during testing. If required, the expense of wasting the return water completely after four cycles would not be so great as to impair the economic feasibility of the process in any event.

Final Product

The recovery of the finished coal product results in a low sulfur coal that is readily usable in existing applications. Referring to Table 1, the reductions in total sulfur content are approximately 95%. Variations in the amount of sulfur actually removed in the process of the present invention will vary depending on the nature of the coal presented, the parameters set for each phase of the process, the efficiency of the dewatering device among other factors.

A noticeable reduction in ash occurs as well, largely the result of the flotation process. Recovery of coal product is typically high, the losses in output being attributable to the inclusion of coal particulates in ash, the collection of fines in air filters and dust traps, and other portions of the process steps. The losses are not extreme and can be reduced by policing the recovery of fines as previously described within this specification.

TABLE 1

| | COAL CONSTITUENTS | |
|---|---|---|
| | Before Processing | After Processing |
| ASH | 25.0% | 5.8% |
| SULFUR | 5.0% | 0.25% |
| MOISTURE | 21.0% | 8.0% |

Those fines that are recovered may be processed through the same steps as herein described. Slight differences allowing for the dynamics of the smaller particles should be made in the rate of additions of the various reagents and in the desired concentration of coal in suspension. Predictably the removal of sulfur from such compounds should occur at a very high rate as an incidence of the increased surface area and penetrability of the reagents. It would be expected that sedimentation and flotation rates may have to be adjusted upwards for time in order to achieve product in the range of 8% moisture content.

From the foregoing, it can be seen that a novel process for the removal of both inorganic and organic sulfurs from coal ore has been described. The advantages of the present invention can be achieved to a greater or lesser extent by slight modifications in the parameters or in the reagents or catalyst described without departing from the spirit and scope of the invention.

The embodiments of the present invention in which an exclusive property or privilege is claimed are defined as follows:

1. A process for the desulfurization of coal ore containing both organic and inorganic sulfur, comprising the steps of:

pulverizing coal ore to particle coal size less than 150 microns;

slurrying the particle coal with an effective concentration of abstraction chemicals comprised of at least one reagent for abstracting organic sulfur from the particle coal and water, creating a slurry solution;

mixing and reacting the abstraction chemicals with organic sulfur in the particle coal, such that the organic sulfur is abstracted from the particle coal and released to the slurry solution;

removing the abstracted organic sulfur and recyclable chemicals from the slurry solution by placing the slurry solution in contact with a membrane in a membrane cell through which the abstracted organic sulfur and recyclable chemical passes but through which the particle coal and water does not pass;

transferring the particle coal and water to a conditioner cell and mixing the particle coal and water with an effective concentration of conditioner reagents comprised of reagents for promoting the floatation of the particle coal and for the sedimentation of mineral type compounds in the conditioner cell;

transferring conditioned particle coal and water to at least one clarifying cell and regulating and mixing an effective concentration of frothing agent comprised of at least one chemical for inducing frothing in the clarifying cell;

separating inorganic sulfurs from the particle coal and water by sedimentation;

separating desulfurized particle coal from water by floatation;

transferring desulfurized particle coal to a dewatering device; and dewatering the desulfurized particle coal and discharging recovered desulfurized coal product.

2. A process for the desulfurization of coal ore containing organic sulfur comprising the steps of:

pulverizing coal ore to an effective particle coal size;

slurrying the particle coal with an effective concentration of abstraction chemicals comprised of at least one reagent for abstracting organic sulfur from the particle coal and liquid vehicle, creating a slurry solution;

mixing and reacting the abstraction chemicals with organic sulfur in the particle coal, abstracting the organic sulfur from the particle coal and releasing it to the slurry solution;

removing the abstracted organic sulfur and recyclable chemicals from the slurry solution by placing the slurry solution in contact with a membrane in a membrane cell through which the abstracted organic sulfur and recyclable chemical passes but through which the particle coal and liquid vehicle does not pass;

transferring the particle coal and the liquid vehicle to a dewatering unit; and separating the liquid vehicle from the desulfurized particle coal and discharging recovered coal product.

3. A process for the desulfurization of coal as in claim 2 where the vehicle is water, ethanol, methanol or combinations thereof.

4. A process for the desulfurization of coal as in claim 1 or 2 where the abstraction chemicals include a catalyst comprising molybdenum dissolved in a benzene.

5. A process for the desulfurization of coal as in claim 1 or 2 where the abstraction chemicals include a hydrogen donator comprising a sodium borohydride prepared by reacting condensed dibromic with tetra alkoxyborate, or a cyanoborohydride, or a combination thereof.

6. A process for the desulfurization of coal as in claim 1 or 2 where the membrane cell is a reverse osmosis membrane.

7. A process for the desulfurization of coal as in claim 6 where the reverse osmosis membrane comprises a cellulose acetate polymer.

8. A process for the desulfurization of coal as in claim 7 where the apparent pore size of the cellulose acetate polymer is about 8 microns.

9. A process for the desulfurization of as in claim 1 where the conditioning reagents include pyrogallol, dichlorodimethylsilane and quebracho.

10. A process for the desulfurization of coal as in claim 1 where the frothing agent is a combination of eucalyptus oil, cresylic acid and Dow Froth special selection.

11. A process for chemical abstraction of organic sulfur from coal comprising:

pulverizing coal ore into particulates;

adding water and adjusting the pH to approximately 7.0;

adding a water soluble hydrogen donating chemical;

adding molybdenum dissolved in a liquid organic matrix selected from the group consisting of aromatic-olefins capable of reversibly reacting with $H_2S$; and separating the coal particulates from the water, hydrogen donator, molybdenum and organic matrix.

12. A process as in claim 11 where the organic matrix is benzene.

13. A process as in claim 3 or 10 further comprising the step of regenerating the molybdenum and benzene by purging with a hydrogen source.

14. A process as in claim 11 where the hydrogen donator is a sodium borohydride prepared by reacting condensed dibromic with tetra alkoxyborate or a cyanoborohydride or a combination thereof.

* * * * *